United States Patent [19]

Chiu

[11] Patent Number: 5,034,162

[45] Date of Patent: Jul. 23, 1991

[54] HIGH CAPACITY PORTABLE HUMIDIFIER

[75] Inventor: Bernard Chiu, Ashland, Mass.

[73] Assignee: Duracraft Corporation, Sudbury, Mass.

[21] Appl. No.: 509,885

[22] Filed: Apr. 17, 1990

[51] Int. Cl.[5] ..... B01F 3/04

[52] U.S. Cl. ..... 261/24; 261/107

[58] Field of Search ..... 261/24, 107, 99

[56] References Cited

U.S. PATENT DOCUMENTS

| | | | |
|---|---|---|---|
| 1,625,663 | 4/1927 | Kelly | 261/104 |
| 2,054,200 | 9/1936 | Langford | 261/107 |
| 2,508,530 | 5/1950 | Morris | 261/107 |
| 2,774,581 | 12/1956 | Bowersox | 261/99 |
| 2,998,714 | 9/1961 | Bonzer | 261/DIG. 4 |
| 3,045,450 | 7/1962 | Chandler | 261/904 |
| 4,698,188 | 10/1987 | Gutmann | 261/107 |
| 4,719,057 | 1/1988 | Mizoguchi | 261/DIG. 48 |
| 4,853,161 | 8/1989 | Huang | 261/DIG. 48 |

FOREIGN PATENT DOCUMENTS

| | | | |
|---|---|---|---|
| 1261072 | 4/1961 | France | 261/107 |

*Primary Examiner*—Tim Miles

*Attorney, Agent, or Firm*—John E. Toupal; Harold G. Jarcho

[57] ABSTRACT

A portable humidifier including a base defining a reservoir; a storage tank demountably supported by the base and adapted to retain a supply of liquid, the tank defining an orifice communicating with the reservoir; and a valve for controlling liquid flow from the tank into the reservoir through the orifice, the valve adapted to provide a liquid flow rate that maintains a given liquid level in the reservoir. Also included is a wick means comprising supply portions disposed in the reservoir below the given liquid level and evaporation portions disposed above that level, the wick means adapted to provide by capillary action a liquid flow from the supply portions to the evaporation portions; a housing defining an air flow path including the evaporation portions, the housing defining inlet openings and discharge openings; and a blower for producing air flow into the inlet openings, through the evaporation portions, and out of the discharge openings. The combination of a base reservoir and a demountable storage tank enhances the storage volume to unit size of the humidifier.

7 Claims, 2 Drawing Sheets

HIGH CAPACITY PORTABLE HUMIDIFIER

BACKGROUND OF THE INVENTION

This invention relates generally to a humidifier and, more particularly, to a portable humidifier utilizing wick elements for supplying liquid for evaporation.

Portable humidifiers are used extensively to increase the moisture content of air so as to enhance the comfort level within an enclosed area. One well known type of humidifier employs a wick element to move by capillary action liquid from a portion thereof submerged in a water bath to another portion thereof exposed to evaporation inducing air flow. In one humidifier of this type, a fixed wick element is retained partially submerged in a low capacity evaporative sump in which a constant water level is maintained by a supply of water from a separate reservoir under the control of a valve. In another type of wick humidifier, a motor driven wick element has portions that are sequentially translated between a position within a large capacity water filled reservoir to a position through which air is forcibly moved to produce evaporation. Because of the requirement for retaining wick elements in positions partially submerged and partially exposed to moving air, prior wick humidifiers have required an overall volumetric size that is significantly greater than their maximum water storage capacity.

The object of this invention, therefore, is to improve the water storage capacity to overall unit volume ratio for a portable wick type humidifier.

SUMMARY OF THE INVENTION

The invention is a portable humidifier including a base defining a reservoir; a storage tank demountably supported by the base and adapted to retain a supply of liquid, the tank defining an orifice communicating with the reservoir; and a valve for controlling liquid flow from the tank into the reservoir through the orifice, the valve adapted to provide a liquid flow rate that maintains a given liquid level in the reservoir. Also included is a wick means comprising supply portions disposed in the reservoir below the given liquid level and evaporation portions disposed above that level, the wick means adapted to provide by capillary action a liquid flow from the supply portions to the evaporation portions; a housing defining an air flow path including the evaporation portions, the housing defining inlet openings and discharge openings; and a blower for producing air flow into the inlet openings, through the evaporation portions, and out of the discharge openings. The combination of a base reservoir and a demountable storage tank enhances the storage volume to unit size of the humidifier.

According to one feature of the invention, the housing is demountably supported by the base, and the housing and the tank cover the reservoir when mounted in juxtaposition on the base. This compact arrangement simplifies cleaning requirements of the reservoir.

According to other features of the invention, the base includes base side walls substantially vertically aligned with housing side walls that define the inlet openings, the wick supply portions comprise supply surfaces disposed closely adjacent to and substantially parallel to the base side walls, and the wick evaporation portions comprise evaporation surfaces disposed closely adjacent to and substantially parallel to the housing side walls. This arrangement facilitates maximization of storage volume.

According to yet other features of the invention, the wick means comprises a plurality of wick elements each defining a portion of the supply surfaces adjacent to and substantially parallel to a different one of the base side walls and a portion of the evaporation surfaces adjacent to and substantially parallel to a different one of the housing side walls. This arrangement further maximizes storage volume capacity and improves air flow efficiency.

According to further features of the invention, the discharge openings are formed in a housing top wall that supports the blower and the wick elements are demountably retained by the base. Reservoir cleaning is further accommodated by these structural features.

According to an additional feature of the invention, the storage volume of liquid at the given level in the reservoir is at least twenty five percent the maximum volume defined by the tank. The provision of a relatively large reservoir capacity permits a significant improvement in the storage volume to unit size characteristics of the humidifier.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
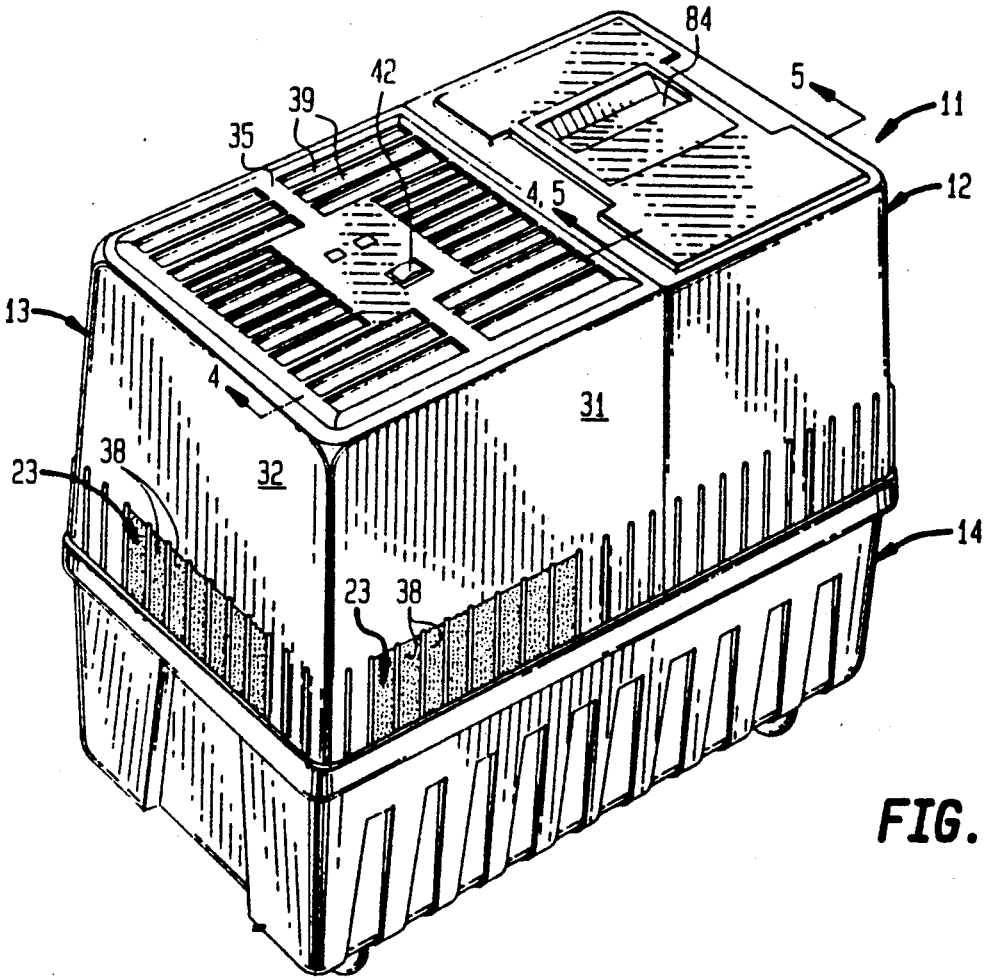
FIG. 1 is a front perspective view of a portable humidifier according to the invention.

A humidifier unit 11 includes a water storage tank 12 and an evaporator housing 13 supported in juxtaposition on a base 14. As shown most clearly in FIG. 3, the base 14 includes a bottom wall 15 and side walls 16–19 that together define a reservoir 21. Projecting inwardly from each of the base side walls 16–18 in a region below the evaporator housing 13 is a rectangularly shaped, horizontally oriented bracket 22. Each of the brackets 22 retains a wick element 23 having a framework 24 forming a plurality of compartments each filled with a suitable absorbant capillary wick material 25. A lower supply portion 26 of each wick element 23 is positioned below its horizontal retaining bracket 22 within the reservoir 21 while an upper evaporation portion 27 thereof is disposed above its bracket 22 and above the reservoir 21. Projecting upwardly from the bottom 15 of the base 14 is a stem 28, the purpose of which is described hereinafter.

The evaporator housing 13 is formed by side walls 31–34 and a top wall 35 and has an open bottom end 36 opening into the reservoir 21. Supporting the bottom end 36 of the housing 13 is an internal shoulder 37 on the base 14. The housing side walls 31–33 are aligned with and directly above, respectively, the base side walls 16–18. Formed in lower portions of each of the housing side walls 31–33 are a plurality of inlet opening slots 38 while a plurality of discharge opening slots 39 are formed in the top wall 35. The interior of the evaporator housing 13 forms parallel air flow paths extending between the inlet slots 38 in each of the housing side walls 31-33 and the discharge slots 39 in the top wall 35. Supported by the top wall 35 and extending into the evaporator housing 13 is a blower assembly 41 that is controlled by an on-off switch 42. A conventional float switch 43 supported by the housing 13 and extending into the reservoir 21 is electrically coupled to the blower assembly 41.

Figure 5:
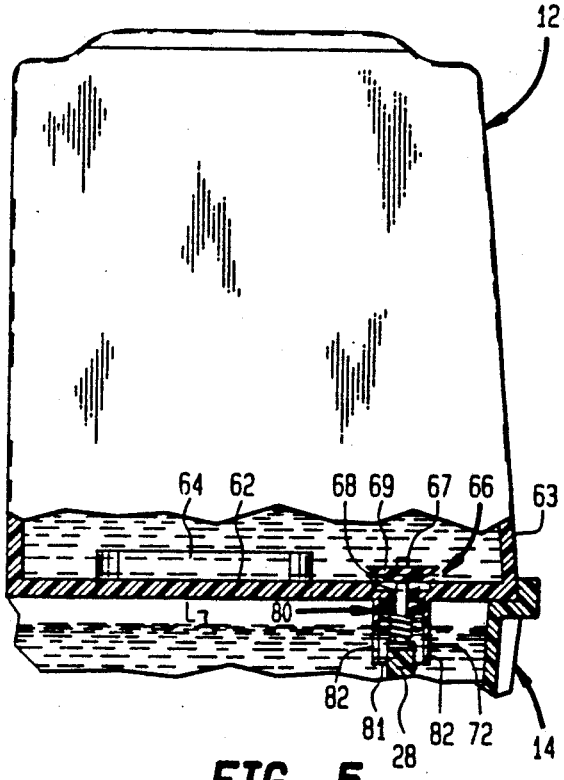
FIG. 5 is a cross-sectional view taken along lines 5—5 of FIG. 1.

The supply tank 12 includes a bottom wall portion 62 supported by the shoulder 37 of the base 14 and an upper portion 63 for storing a supply of liquid such as water. Closing an opening in the bottom wall portion 62 is a threaded cap 64 that can be removed to fill the tank 12. A valve assembly 66 is retained in the bottom wall portion 62 of the tank 12. Forming the valve assembly 66 is a valve stem 67 extending through a discharge orifice 68 in the bottom wall portion 62 and a valve 69. A spring 71 extending between the bottom wall portion 62 and a plate 72 mounted on an end of the stem 67 normally biases the valve 69 into a seated position closing the discharge orifice 68 as shown by dashed lines in FIG. 5. Projecting downwardly from the bottom wall portion 62 and enclosing a lower portion of the valve assembly 66 is a skirt 80 having an open bottom end 81 intersected by slots 82. A handle recess 84 is formed in a cover portion of the tank 12.

OPERATION

To prepare the humidifier 11 for use, the tank 12 is removed from the base 14 and the reservoir is filled with water to a level L. In addition, the tank 12 is filled through an opening created by removal of the cap 64. With the cap 64 replaced and the normally seated valve 69 seated over the opening 68, the sealed tank 12 is inverted and positioned on the base 14. Engagement of the plate 72 on the valve stem 67 with the actuator stem 28 on the base 14 moves the valve 69 into an open position as shown by solid lines in FIG. 5. Accordingly, water from the tank 12 flows through the opened valve 69 and the inlet orifice 68 into the reservoir 21. As long as a supply of water exists in the sealed tank 12, the water level L determined by the height of the slots 82 in the skirt 80 will be retained by the open valve 69.

Figure 3:
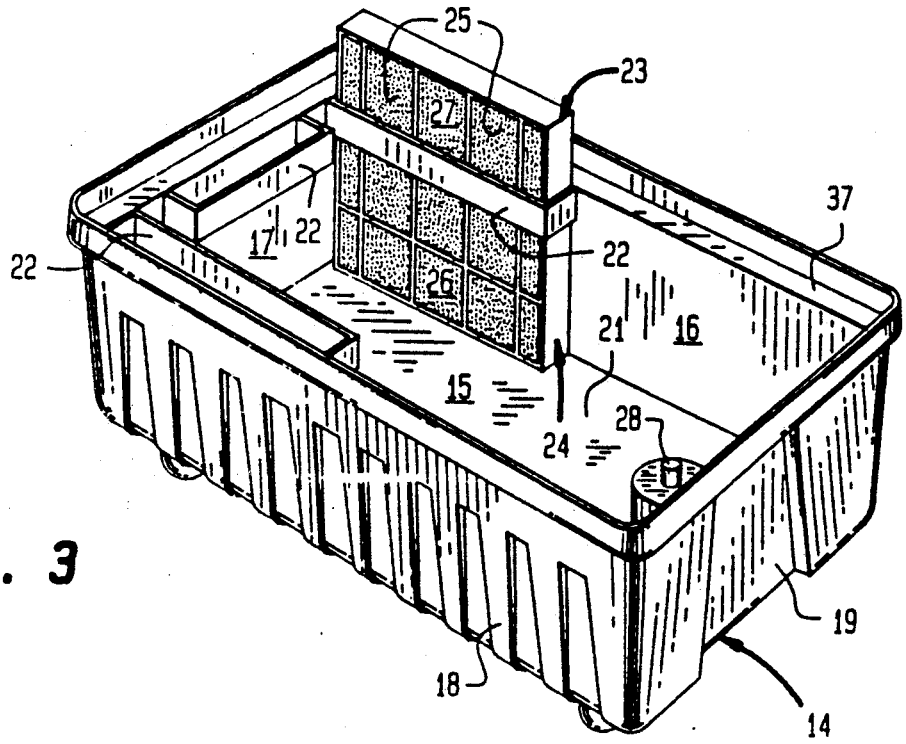
FIG. 3 is a rear perspective view of a base unit of the humidifier shown in FIG. 1.
Figure 4:
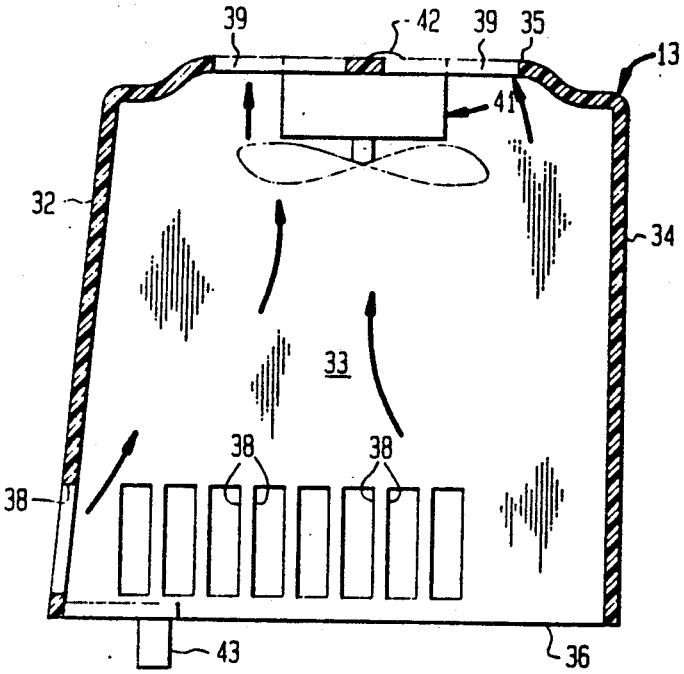
FIG. 4 is a cross-sectional view taken along lines 4—4 of FIG. 1.
Figure 2:
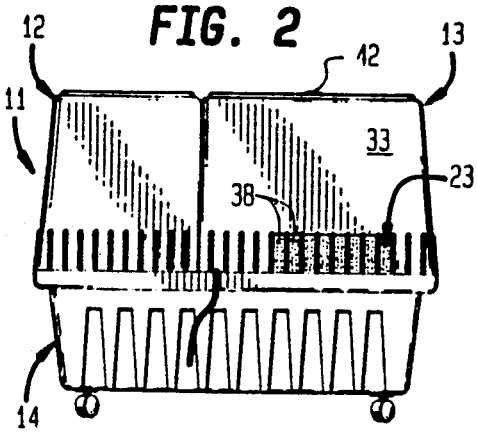
FIG. 2 is a rear elevational view of the humidifier shown in FIG. 1.

Prior to initiating operation of the humidifier unit 11, one of the wick elements 23 is appropriately positioned within each of the brackets 22 on the base 14 after removal of the housing 13. As shown in FIG. 3, with the wick element 23 properly positioned, its supply portion 26 includes an outer surface disposed directly adjacent and parallel to the base side wall 16. Also an outer surface of the evaporator portion 27 of the wick element 23 is disposed directly adjacent and parallel to the inlet slots 38 formed in the housing side wall 31. Although for reasons of clarity, only a single wick element 23 is shown in FIG. 3, it will be understood that an identical wick element will be similarly positioned in each of the brackets 22. Consequently, the supply portion of each wick element 23 will be below the surface level L of the water in the reservoir 21 while the evaporator portion 27 of each element 23 will lie above the water surface level L and directly in an air flow path between one set of the inlet slots 38 and the discharge slots 39.

Actuation of the switch 42 activates the blower 41 producing between the inlet slots 38 and the discharge slots 39 air flow that removes moisture from the evaporation portions 27 of the wick elements 23. If the supply of water in the tank 12 is exhausted and the level of water in the reservoir 21 subsequently falls to a predetermined minimum level below the desired operating level L, the float switch 43 responds to deactivate the blower 41 and terminate humidifier operation. A resumption of operation can be followed by again filling with water the tank 12 and the reservoir 21 in the manner described above.

Obviously, many modifications and variations of the present invention are possible in light of the above teachings. It is to be understood, therefore, that the invention can be practiced otherwise than as specifically described.

What is claimed is:

1. A portable humidifier comprising:

a base means defining a reservoir adapted to retain liquid;

a storage tank means demountably supported by said base means above said reservoir and adapted to retain a supply of liquid, said tank means defining an orifice communicating with said reservoir;

valve means for controlling liquid flow from said tank means into said reservoir through said orifice, said valve means adapted to maintain said liquid flow at a rate that maintains a given liquid level in said reservoir;

wick means comprising supply portions disposed in said reservoir below said given level and evaporation portions disposed above said given level, said wick means adapted to provide by capillary action a liquid flow from said supply portions to said evaporation portions;

housing means demountably supported by said base means above said reservoir and defining an air flow path including said evaporation portions and discharge opening means and wherein said housing means and said tank means cover substantially all of said reservoir when mounted in juxtaposition on said base means and the volume of liquid at said given level in said reservoir is at least twenty five percent the maximum volume defined by said tank means; and blower means retained by said housing means for producing air flow through said evaporation portions, and out of said discharge opening means.

2. A portable humidifier according to claim 1 wherein said housing means comprises housing side wall means defining inlet opening means directly adjacent to said evaporation portions and communicating with said air flow path.

3. A portable humidifier according to claim 2 wherein said base means comprises base side wall means substantially vertically aligned with said housing side wall means, said wick supply portions comprise supply surface means disposed closely adjacent to and substantially parallel to said base side wall means, and said wick evaporation portions comprise evaporation surface means disposed closely adjacent to and substantially parallel to said housing side wall means.

4. A portable humidifier according to claim 3 wherein said housing side wall means defines a plurality of housing side walls, said base side wall means defines a plurality of base side walls, said wick means comprises a plurality of wick elements each defining a portion of said supply surface means adjacent to and substantially parallel to a different one of said base side walls and a portion of said evaporation surface means adjacent to and substantially parallel to a different one of said housing side walls.

5. A portable humidifier according to claim 4 wherein said housing means further comprises a top wall defining said discharge opening means.

6. A portable humidifier according to claim 5 wherein said blower means is supported by said top wall.

7. A portable humidifier according to claim 6 wherein said base comprises retainer means retaining said wick elements.

* * * * *